United States Patent [19]

Amundsen

[11] 4,155,201

[45] May 22, 1979

[54] HONING APPARATUS FOR ENGINE BLOCKS

[75] Inventor: Leonard C. Amundsen, Albany, Ga.

[73] Assignee: AWS Corporation, Albany, Ga.

[21] Appl. No.: 870,827

[22] Filed: Jan. 19, 1978

[51] Int. Cl.[2] ..... B24B 33/02

[52] U.S. Cl. ..... 51/34 C; 51/217 A; 408/61

[58] Field of Search ..... 51/34 C, 217 A, DIG. 15; 408/60, 61, 89, 98, 109, 127, 136, 234, 235, 236, 237, 241 S, 709

[56] References Cited

U.S. PATENT DOCUMENTS

| | | | |
|---|---|---|---|
| 753,058 | 2/1904 | Flocke | 408/237 X |
| 1,195,145 | 8/1916 | Mattingly | 408/61 X |
| 1,548,142 | 8/1925 | Jennings | 408/127 |
| 1,700,980 | 2/1929 | Galloway | 408/61 X |
| 2,369,828 | 2/1945 | Humphreys | 408/61 X |
| 2,879,678 | 3/1959 | Kaiser | 408/236 X |
| 3,053,119 | 9/1962 | Anderson | 408/109 X |
| 3,088,341 | 5/1963 | Roman-Garcia | 408/237 X |
| 3,273,423 | 9/1966 | Rottler | 408/89 X |

FOREIGN PATENT DOCUMENTS

| | | | |
|---|---|---|---|
| 400942 | 10/1933 | United Kingdom | 51/34 C |

*Primary Examiner*—Gary L. Smith

*Attorney, Agent, or Firm*—Sutherland, Asbill & Brennan

[57] ABSTRACT

An apparatus for honing the cylinder walls of a piston engine comprising:

a tank having an open top, a vertical column mounted on one side of the tank and being movable along the side of the tank, a generally horizontal lower arm pivotably mounted at one of its ends to the column and projecting over the tank, the lower arm being vertically pivotable in a plane that is substantially perpendicular to the path of movement of the column, a motor pivotably mounted on the lower arm to be vertically pivotable in a plane that is substantially perpendicular to the path of movement of the column, the motor having a drive train terminating in a chuck for receiving the arbor of a rotatable honing stone assembly, an upper arm pivotably mounted to the vertical column and being vertically pivotable in the same plane as the lower arm, a downward projecting cradle fixed to the upper arm and supporting the lower arm, the lower arm being in free sliding contact with the cradle, a spring connecting the rearward end of the upper arm to the vertical column and exerting a downward force on the rearward end of the upper arm which counters the downward force exerted on the forward end of the lower arm by the weight of the motor, a handle extension on the lower arm suitable to be grasped and urged downward so as to move the motor toward the bottom of the tank, against the force of the spring, a mount for holding a piston engine block inside the tank with the cylinder openings aligned under the path of horizontal movement of the chuck, and a pump for continuously pumping honing oil from the bottom of the tank and pouring it down a cylinder wall of an engine block mounted inside the tank.

16 Claims, 5 Drawing Figures

FIG. 3
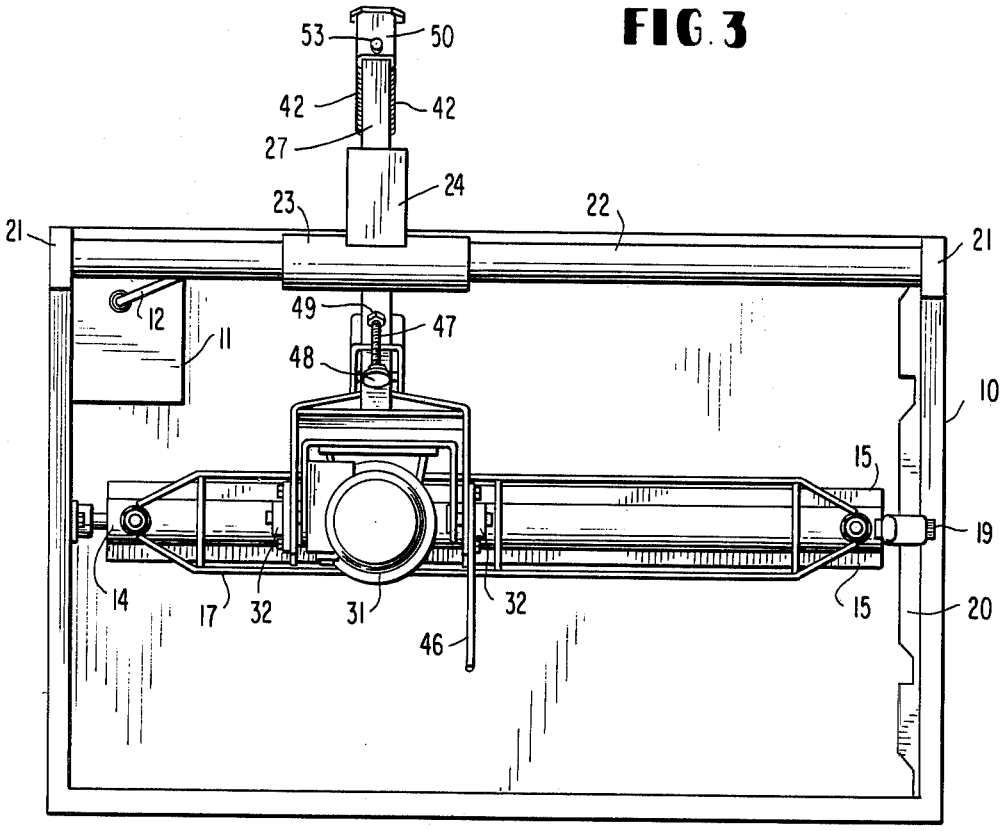
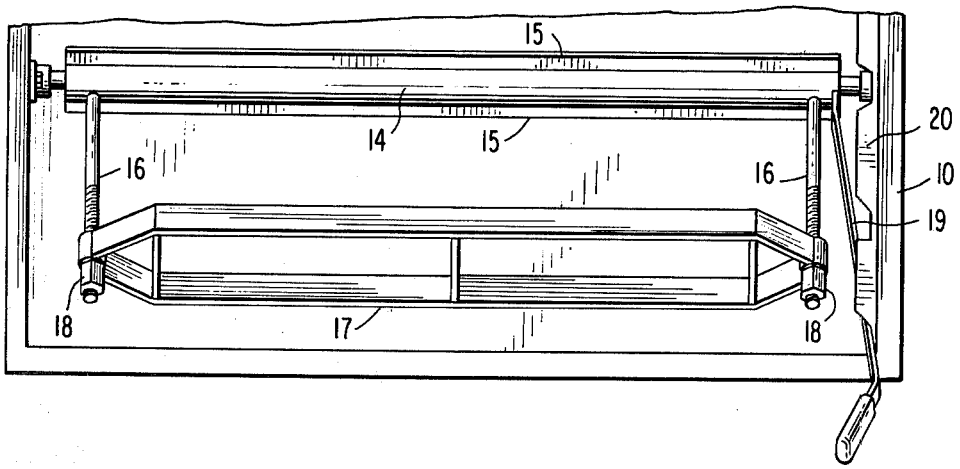
FIG. 4

HONING APPARATUS FOR ENGINE BLOCKS

This invention concerns an apparatus for honing the cylinder walls of piston engines. Most especially it concerns such an apparatus for use in rebuilding internal combustion piston engines for cars and trucks.

Piston engine cylinders whose walls are scratched, ring-ridged, glazed, or wavy are routinely honed, i.e., treated with a rotating honing stone assembly, in order to restore the proper cylinder wall finish and improve engine performance. The honing operation gradually and evenly removes surface metal to obtain a uniform finish. Honing is especially recommended after cylinder reboring. A boring bar leaves tool marks in a cylinder wall which resemble furrows of a plowed field. The depth of the furrows will usually be in the range of about 60 to 100 microinches or more. If not smoothed by honing, the engine will be noisy and exhibit excessive oil consumption and blow-by, at least until the piston rings wear down the tops of the furrows. A further problem of using an "as bored" cylinder is that small pieces of metal that are broken loose by the rings will circulate in the engine and cause excessive wear of bearings and other moving parts.

A rotatably honing stone assembly comprises oil stones adjustably mounted on an arbor for rotation within the cylinders. Precision honing machines which perform the operation almost automatically, using sophisticated apparatus for raising and lowering the honing stone assembly, have long been in use. Because of their design these machines are prohibitively expensive for garages and machine shops having a low volume of engine rebuilding business. The alternative that has been available until now is merely the use of a portable electric drill fitted with a rotatable honing stone assembly. The problems with that method arise from the fact that the drill must be handheld. If the stones get "hung up" in the cylinder, the resulting torque can whip the drill out of the operator's hands, frequently causing injury. Broken wrists are a well known occupational hazard for mechanics who do finish honing using portable electric drills.

Another shortcoming of handheld honing is that it requires substantial vertical pressure to force the rotating honing assembly up and down inside the cylinder, which makes the operation laborious and time consuming. Still another drawback is its inability to remove the taper that occurs in cylinder bottoms after reboring. Operation of a boring bar leaves a taper in the bottom region of a cylinder such that the diameter there will usually be about 0.0003 to 0.0007 inch less than in the upper regions. For all practical purposes, human strength is inadequate to the task of removing that taper by handheld honing.

The present invention answers the need for a honing apparatus in which the motor does not have to be held in the hand, which provides a mechanical advantage for moving the honing head up and down in a cylinder, but which is relatively inexpensive to fabricate. The apparatus of the present invention comprises a rectilinear tank having an open top; a generally vertical column mounted on one side of the tank and extending above the top of the tank, the column being so mounted as to be horizontally movable along the side of the tank; a generally horizontal lower arm pivotably mounted at one of its ends to the column at a point intermediate the top and bottom of the column and projecting over the tank, the lower arm being vertically pivotable in a plane that is substantially perpendicular to the path of movement of the column; a motor pivotably mounted on the lower arm to be vertically pivotable in a plane that is substantially perpendicular to the path of movement of the column, the motor having a drive train terminating in chuck means for receiving the arbor of a rotatable honing stone assembly; an upper arm pivotably mounted intermediate its ends to the vertical column, the upper arm pivot point being higher up the column than the lower arm pivot point, the upper arm having a forward end projecting over the tank and a rearward end extending away from the tank, the upper arm being vertically pivotable in the same plane as the lower arm; downward projecting cradle means fixed to the upper arm and supporting the lower arm at a point intermediate the column and the motor, the lower arm being in free sliding contact with the cradle means; spring means connecting the rearward end of the upper arm to the vertical column, the spring means being anchored to the column at a point below the pivot point of the upper arm, the spring means exerting a downward force on the rearward end of the upper arm which counters the downward force exerted on the forward end of the lower arm by the weight of the motor; a handle extension on the lower arm which is suitable to be grasped and urged downward so as to move the motor toward the bottom of the tank, against the force of the spring means; mounting means for holding a piston engine block inside the tank; and means for continuously pumping honing oil from the bottom of the tank and pouring it down a cylinder wall of an engine block mounted inside the tank.

Use of the honing apparatus of the present invention is quite simple. The engine block is mounted in the tank, honing oil is pooled in the bottom of the tank, a rotatable honing stone assembly having a flexible arbor is mounted in the chuck, the motor is poised over the first cylinder to be honed, the spread of the honing stones is adjusted to the diameter of the cylinder, the handle is partially lowered while inserting the stone assembly a short distance into the cylinder, the oil pump is activated and the flow of oil is directed onto the cylinder wall, the honing motor is turned on, and the handle is lowered and raised a few times, until the cylinder wall has the desired finish, after which the honing motor is turned off and moved to the next cylinder, where the procedure is repeated.

The mechanism supporting the honing motor in the apparatus of the present invention enables the motor to be lowered with the exertion of a relatively steady amount of force at all positions. The spring means serve to counter the weight of the motor. Preferably they will be strong enough to pull the honing motor to its topmost position when no operator pressure is applied downwardly on the handle extension. The particular arrangement of upper and lower arms in the apparatus of the present invention provides a shifting fulcrum under the lower arm which moves away from the motor when the motor is moved downward, thereby increasing the leverage at the motor end of the lower arm, which helps offset the increasing tension in the spring means.

Preferably, one of the two arms will be provided with adjustable stop means limiting the downward movement of the honing motor. For example, the cradle means can be equipped with a threaded rod pointing toward the vertical column, which rod can be pre-set so as to abut the column and prevent further downward movement when the honing stone assembly reaches the bottom of the cylinder.

The preferred means of mounting the vertical column on the tank comprise a pair of vertical posts rising from adjacent corners of the tank, a pair of spaced apart, horizontal, parallel rods connecting said posts, and a pair of tubular sleeves slidably mounted on the rods, with the vertical column being attached to the sleeves.

The vertical column, together with the arms and motor mounted on it, can be moved laterally simply by pressing one's hand against the side of the column. Preferably, however, the same movement can be accomplished by sideways pressure on the honing motor, thus avoiding the necessity of reaching all the way across the tank to make each lateral adjustment of the position of the honing stone assembly.

To make it easier to move the assembly by sideways pressure on the motor, it is preferred that the vertical column be offset from the plane of the parallel rods so that the column and the motor are on opposite sides of that plane. Generally, the greater the distance that the vertical column is behind the plane of the tubular sleeves, the easier it will be to reposition the assembly by sideways pressure on the motor. Preferably, however, that distance is not so great as to allow lateral repositioning by sideways pressure on the handle extension, the purpose being to ensure that the operator will not accidentally move the motor sideways as he grips the handle. Lacking that feature it is preferred to equip the apparatus with special means to releasably lock the vertical column in place at any position along its path of horizontal movement.

The cradle means which support the lower arm can be provided by any arrangement of parts which will slidably support the lower arm beneath the upper arm. A U-shaped framework is ideal. Preferably the cradle means will include a horizontally disposed roller on which the lower arm rides.

The mounting means for holding a piston engine block inside the tank should be such as will assure that the cylinder openings will be aligned under the path of horizontal movement of the chuck means, thus enabling the honing stone assembly to be laterally moved from one cylinder to the next without having to adjust the engine mounting mechanism. Preferably the mounting means will include a rotatable, horizontal shaft journaled in the tank, means for holding an engine block on the shaft, and means for locking the shaft against rotation. The purpose of the shaft being rotatable is to better accomodate V configuration engine blocks.

Most internal combustion piston engine blocks have a lengthwise, semi-circular depression, called a "main bearing bore", to receive the crankshaft. The shaft in the tank is preferably positioned so as to fit in that depression. Preferably the shaft will have two flat ridges, or fins, along its length, spaced 180 degrees apart, upon which will rest the flat areas of the engine block that border the sides of the crankshaft depression. The distance from the outer edge of one ridge to the outer edge of the other ridge is preferably in the range of about 4 to 5 inches.

To hold the engine block on the rotatable shaft it is preferred to have parallel rods with threaded ends projecting radially from the shaft, a hold-down bar having sleeved ends adapted to be slid down over the rods, and nut means for tightening the hold-down bar over an engine block mounted on the shaft. Since the hold-down bar must not ride over the cylinder openings, the bar is preferably provided with one or more center openings which are wide enough for access to the cylinders.

The means for locking the engine mounting shaft against rotation may be the combination of a crank arm projecting radially from the shaft near one end thereof, and a rail member, mounted on the end of the tank nearest the crank arm, the rail member having a plurality of notched recesses for receiving and releasably holding the crank arm. Preferably there will be five such recesses, positioned to accommodate the three standard types of automobile and truck engines: in-line engines, V configuration engines having a 90 degree angle between the two rows of cylinders, and V configuration engines having a 60 degree angle between the two rows of cylinders.

Because the honing motor is mounted on a swing arm, it describes an arcuate path as it is raised and lowered. For this reason the apparatus of the present invention must be used with honing stone assemblies having flexible arbors, which are well known in the art, so that the stones will follow the alignment of the cylinder, regardless of the deflection of the motor from vertical. It is preferred to keep vertical deflection to a minimum, however, and this can be accomplished by maximizing the distance from the motor to the lower arm pivot point.

The motor for turning the honing stone assembly can be electric or air driven. It will preferably have an output at the chuck of at least about 250 ft. lb. of torque, e.g., about 300 to 350 ft. lb., and, ideally, should be capable of turning the chuck at a speed of about 80 to 100 rpm under a medium load. The motor is pivotably mounted on the lower arm above the motor's center of gravity, so that the chuck means will be on the underside when the motor is allowed to swing free on its pivot mounts. The chuck means will preferably accommodate arbors up to ½ inch in diameter, since the standard diameters of portable honing stone assemblies are 7/16 inch and ½ inch.

The means for pumping honing oil from the bottom of the tank preferably comprise a submergible electric pump having an output of about 1/30 to 1/50 horsepower, connected to flexible tubing terminating at a point above the engine. Flexible metal tubing which will hold its position without clamping is preferred. Ideally the pumping means will pour the oil down the cylinder wall at a flow rate of about 2.5 to 3.5 gallons per minute, at as low a nozzle pressure as possible. I have found that low pressure, large volume flooding of the hone/cylinder wall interface effectively removes abraded metal from the engine block. When using the honing machines of the prior art, by way of contrast, it has been necessary to wipe the cylinder walls clean of metal particles after conclusion of the honing. That time-consuming step can be omitted when using the preferred apparatus of the present invention.

Preferably, one or more coil springs will be used to connect the rearward end of the upper arm to the vertical column. The strength of spring selected will depend upon the weight of the honing motor, the distance between the upper and lower arms, and the length of the two arms, the objective being the ability to lower the honing motor by applying a uniform downward pressure throughout its trajectory.

The invention will doubtless be better understood by viewing the attached drawings, which illustrate the invention in a preferred embodiment.

Referring to the drawings, FIG. 1 is a front view of the apparatus, in partial cross-section.

FIG. 3 is a top view of the apparatus, showing the engine block mounting shaft at a different position than in FIGS. 1 and 2.

FIG. 4 is a partial top view, along the line 4—4 in FIG. 2.

Figure 1:
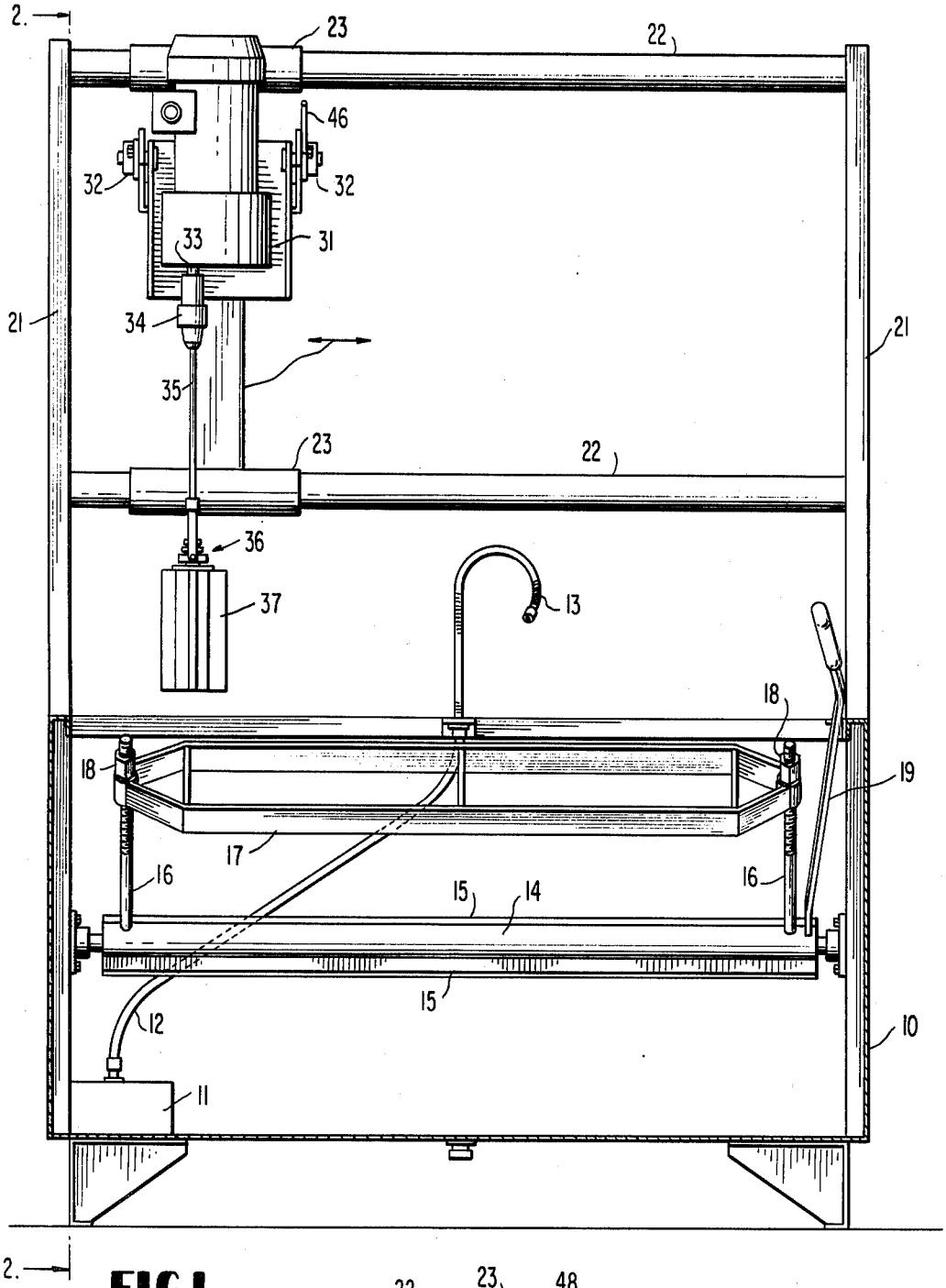
Figure 5:
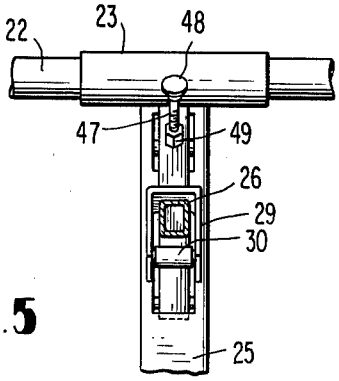
FIG. 5 is a partial front view, along the line 5—5 in FIG. 2.

As shown in the drawings, tank 10 is equipped with a 1/40 horsepower submergible pump 11, which is connected via a length of ⅜ inch I.D. rubber tubing 12 to ¾ inch I.D. metal gooseneck tubing 13, through which honing oil can be delivered to the cylinder walls of an engine block being honed, for example at a rate of about 3 gallons per minute under a negligible nozzle pressure.

Figure 2:
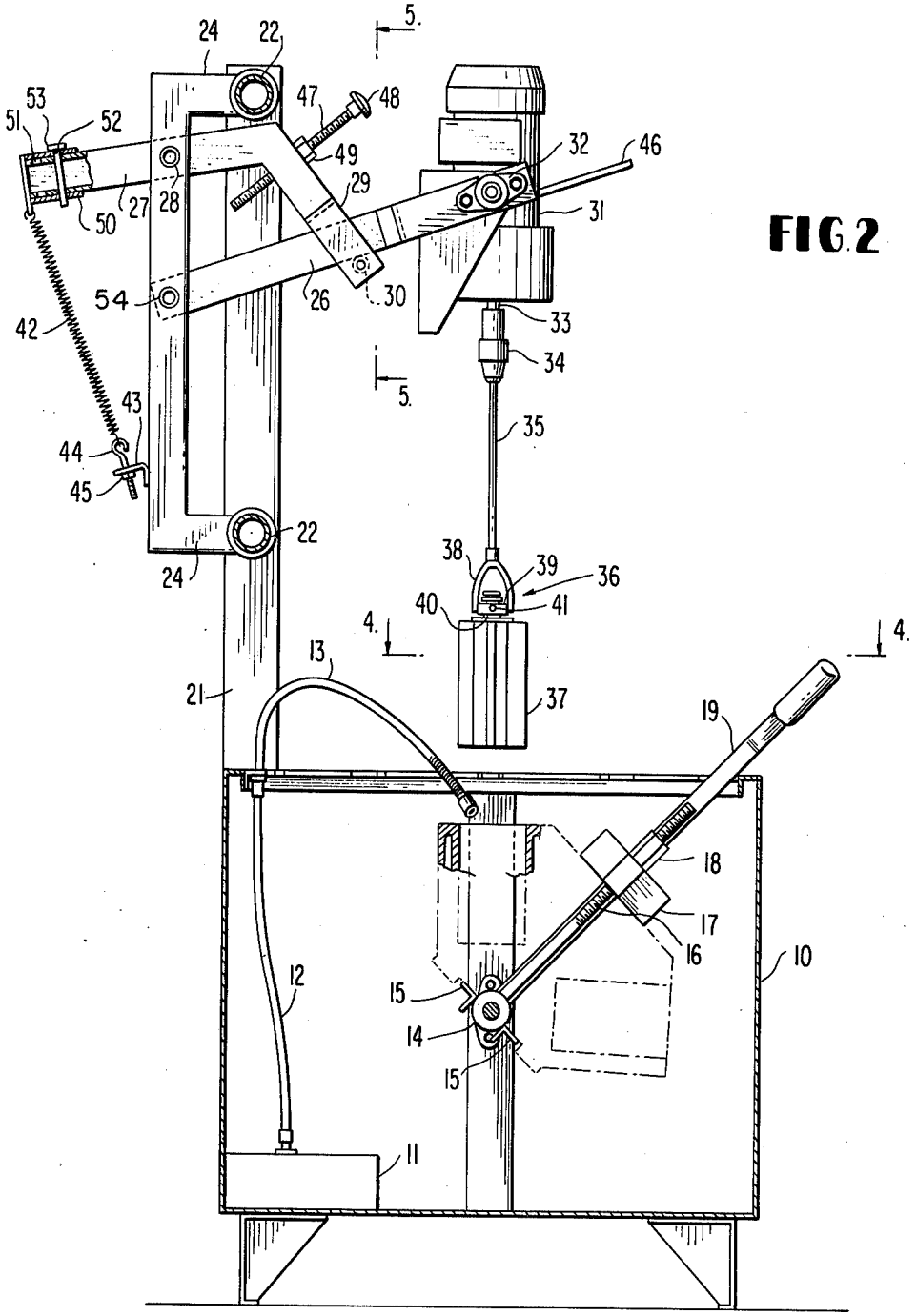
FIG. 2 is a side view, also in partial cross-section, along the line 2—2 in FIG. 1.

Shaft 14, having fins 15, is journaled in tank 10 so as to support an engine block in the manner shown by the broken lines in FIG. 2. Projecting radially from shaft 14 are threaded rods 16, over which is slid hold-down bar 17, which is retained in place over the engine block by nuts 18.

To rotate shaft 14 from one position to another, handle 19 is attached to shaft 14 so it can be releasably held in any of the five notches in rail member 20.

Vertical posts 21 rise from adjacent corners of tank 10 and are connected by parallel, horizontal rods 22. Tubular sleeves 23 are slidably mounted on rods 22 and are joined together by horizontal projections 24 and vertical column 25.

Lower arm 26 is pivotably mounted at one end to column 25 at pivot point 54. Upper arm 27 is pivotably mounted intermediate its ends to column 25 at pivot point 28. Cradle means 29 project downwardly from upper arm 28 and support lower arm 26, which rides on horizontal roller 30.

Electric motor 31 is pivotably mounted on lower arm 26 by means of flange bearings 32. The drive shaft 33 of motor 31 carries a Jacobs chuck 34 for holding the arbor 35 of a standard, portable honing stone assembly 36. Motor 31 develops ½ horsepower at 1725 rpm. The drive shaft is linked to chuck 34 via a 19/1 gear reduction train. Chuck speed under a medium load averages about 90 rpm, providing an output of about 320 ft. lb. of torque.

Honing stones 37 are flexibly attached to ½ inch diameter arbor 35 by means of fork 38, ring 39 (which is pivotably connected to fork 38) and shaft 40 which, in turn, is pivotably attached to ring 39 by pivot pins 41.

Mounted on the rearward end of upper arm 27 is anchor cup 50, which is held to arm 27 by means of headed pin 53 passing through hole 52 of cup 50 and one of the pairs of holes 51 in arm 27. The choice of which pair of holes 51 to use depends upon the amount of downward force desired on the rearward end of arm 27. Hooked onto anchor cup 50 are the ends of three identical, parallel, coil springs 42, the other ends of which are attached to column 25 via bracket 43, eye bolts 44, and nuts 45.

Projecting from the free end of lower arm 26, beyond motor 31, is handle 46 for lowering honing stone assembly 36. A force of about 1 to 2 lbs. is all that is required to fully depress handle 46. Threaded depth adjustment rod 47, having knob head 48, extends through upper arm 27 and is held in place by nut 49 which is welded to arm 27.

In using the honing apparatus depicted in the drawings, an engine block is mounted on shaft 14 and clamped in place with hold-down bar 17 and nuts 18. If necessary, the block is rotated to bring a row of cylinders to the top by repositioning handle 19 and locking it into one of the recesses in rail member 20.

Honing oil is poured into tank 10 (e.g., about 25 to 30 gallons of oil for a 150 gallon tank) and honing stone assembly 36 is poised over the first cylinder to be honed. The diametric spread of stones 37 is set at the desired finished diameter of the cylinder. Threaded rod 47 is turned to the position for stopping the downward movement of honing stone assembly 36 at the bottom of the cylinder, and handle 46 is then pushed downward while honing stone assembly 36 is guided partially into the cylinder by hand. The nozzle of gooseneck tubing 13 is positioned over the cylinder, oil pump 11 is activated, and motor 31 is turned on to begin the actual honing. Handle 46 is lowered until checked by depth adjustment rod 47, is raised to bring the bottom of stones 37 to near the top of the cylinder, and is then lowered and raised the number of times required to get the desired finish. Motor 31 is then turned off and honing stone assembly 36 is moved laterally to a position over the next cylinder to be honed, where the same sequence is repeated.

The honing apparatus of the present invention not only provides a safer alternative to handheld honing, but it saves considerable time as well. Using the apparatus depicted in the drawings, for example, a mechanic can hone all cylinders of a 350 cubic inch V-8 engine, after boring, to enlarge their diameter by 0.003 inch in about 20 minutes, whereas the same operation performed with a portable electric drill usually requires about 90 minutes, plus 10 to 15 minutes to remove adhered metal grains from the cylinder walls.

I claim:

1. An apparatus for honing the cylinder walls of a piston engine comprising:

a rectilinear tank having an open top, a generally vertical column mounted on one side of the tank and extending above the top of the tank, said column being so mounted as to be horizontally movable along the side of the tank, a generally horizontal lower arm pivotably mounted at one of its ends to the column at a point intermediate the top and bottom of the column and projecting over the tank, said lower arm being vertically pivotable in a plane that is substantially perpendicular to the path of movement of the column, a motor pivotably mounted on the lower arm to be vertically pivotable in a plane that is substantially perpendicular to the path of movement of the column, said motor having a drive train terminating in chuck means for receiving the arbor of a rotatable honing stone assembly, an upper arm pivotably mounted intermediate its ends to the vertical column, the upper arm pivot point being higher up the column than the lower arm pivot point, said upper arm having a forward end projecting over the tank and a rearward end extending away from the tank, said upper arm being vertically pivotable in the same plane as the lower arm, downward projecting cradle means fixed to the upper arm and supporting the lower arm at a point intermediate the column and the motor, said lower arm being in free sliding contact with the cradle means, spring means connecting the rearward end of the upper arm to the vertical column, the spring means being anchored to the column at a point below the pivot point of the upper arm, said spring means exerting a downward force on the rearward end of the upper arm which counters the downward force exerted on the forward end of the lower arm by the weight of the motor, a handle extension on the lower arm, said handle being suitable to be grasped and urged downward so as to move the motor toward the bottom of the tank, against the force of the spring means, mounting means for holding a piston engine block inside the tank with the cylinder openings aligned under the path of horizontal movement of the chuck means, and means for continuously pumping honing oil from the bottom of the tank and pouring it down a cylinder wall of an engine block mounted inside the tank.

2. The apparatus of claim 1 wherein the means by which the vertical column is mounted on the tank include a pair of fixed, vertical posts rising from adjacent corners of the tank, a pair of spaced apart, horizontal, parallel rods connecting said posts, and a pair of tubular sleeves slidably mounted on said rods, said vertical column being attached to said sleeves.

3. The apparatus of claim 2 wherein the vertical column is offset from the plane of the rods and is on the opposite side of said plane from the motor.

4. The apparatus of claim 1 wherein the cradle means include a horizontally disposed roller on which the lower arm rides.

5. The apparatus of claim 2 wherein the cradle means include a horizontally disposed roller on which the lower arm rides.

6. The apparatus of claim 3 wherein the cradle means include a horizontally disposed roller on which the lower arm rides.

7. The apparatus of claim 1 wherein the mounting means for holding an engine block include a rotatable horizontal shaft journaled in the tank, means for holding an engine block on the shaft, and means for locking the shaft against rotation.

8. The apparatus of claim 7 wherein the shaft has two flat ridges along its length, spaced 180 degrees apart, the distance from the outer edge of one ridge to the outer edge of the other ridge being in the range of about 4 to 6 inches.

9. The apparatus of claim 7 wherein the means for locking the shaft against rotation comprise a crank arm projecting radially from said shaft near one end thereof and a rail member mounted on the end of the tank nearest the crank arm, said rail member having a plurality of notched recesses, each recess serving to receive and releasably hold the crank arm.

10. The apparatus of claim 6 wherein the means for holding an engine block on the horizontal shaft include parallel rods having threaded ends projecting radially from each end of the shaft, a hold-down bar having sleeved ends adapted to be slid down over said rods, and nut means for tightening the bar over an engine block mounted on the shaft.

11. The apparatus of claim 7 wherein the means for holding an engine block on the horizontal shaft include parallel rods having threaded ends projecting radially from each end of the shaft, a hold-down bar having sleeved ends adapted to be slid down over said rods, and nut means for tightening the bar over an engine block mounted on the shaft.

12. The apparatus of claim 10 wherein the shaft has two flat ridges along its length, spaced 180 degrees apart, the distance from the outer edge of one ridge to the outer edge of the other ridge being in the range of about 4 to 6 inches.

13. The apparatus of claim 12 wherein the means for locking the shaft against rotation comprise a crank arm projecting radially from said shaft near one end thereof and a rail member mounted on the end of the tank nearest the crank arm, said rail member having a plurality of notched recesses, each recess serving to receive and releasably hold the crank arm.

14. The apparatus of claim 13 wherein the shaft has two flat ridges along its length, spaced 180 degrees apart, the distance from the outer edge of one ridge to the outer edge of the other ridge being in the range of about 4 to 6 inches.

15. The apparatus of claim 14 wherein the motor is electric and the spring means are one or more coil springs.

16. The apparatus of claim 15 wherein the means for pumping honing oil comprise a submergible electric pump connected to flexible metal tubing terminating at a point above an engine block mounted in the tank.

* * * * *